US010563598B2

(12) United States Patent
Cho et al.

(10) Patent No.: US 10,563,598 B2
(45) Date of Patent: Feb. 18, 2020

(54) ENGINE OPERATING SYSTEM AND METHOD

(71) Applicant: Ford Global Technologies, LLC, Dearborn, MI (US)

(72) Inventors: Hoon Cho, Rochester, MI (US); Brien Fulton, Bloomfield Hills, MI (US); Michiel J. Van Nieuwstadt, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 248 days.

(21) Appl. No.: 15/844,324

(22) Filed: Dec. 15, 2017

(65) Prior Publication Data

US 2019/0186389 A1 Jun. 20, 2019

(51) Int. Cl.

| | |
|---|---|
| ***F02D 35/02*** | (2006.01) |
| ***F02D 41/00*** | (2006.01) |
| ***F02D 37/02*** | (2006.01) |

(52) U.S. Cl.

CPC ..... *F02D 35/024* (2013.01); *F02D 35/023* (2013.01); *F02D 37/02* (2013.01); *F02D 41/005* (2013.01); *F02D 41/008* (2013.01); *F02D 41/0077* (2013.01); *F02D 41/0007* (2013.01); *F02D 2200/04* (2013.01); *F02D 2200/101* (2013.01)

(58) Field of Classification Search

CPC ..... F02D 35/024; F02D 41/0007; F02D 41/0077; F02D 2200/04; F02D 2200/101; F02D 41/005; F02D 41/008; F02D 35/023; F02P 5/1516

See application file for complete search history.

(56) References Cited

U.S. PATENT DOCUMENTS

| | | | | |
|---|---|---|---|---|
| 4,539,841 | A | 9/1985 | Schroeder et al. | |
| 4,995,351 | A | 2/1991 | Ohkubo et al. | |
| 6,354,268 | B1 | 3/2002 | Beck et al. | |
| 6,843,231 | B1 | 1/2005 | Duffy et al. | |
| 9,188,505 | B2 | 11/2015 | Martin | |
| 2002/0195086 | A1 | 12/2002 | Beck et al. | |
| 2008/0162017 | A1* | 7/2008 | Nagata | F02D 35/02 701/103 |
| 2008/0201060 | A1* | 8/2008 | Nagai | F02D 35/023 701/103 |
| 2009/0055084 | A1* | 2/2009 | Ishizuka | F02D 41/40 701/105 |
| 2009/0063010 | A1* | 3/2009 | Nakata | F02D 35/028 701/103 |

(Continued)

FOREIGN PATENT DOCUMENTS

| | | | | |
|---|---|---|---|---|
| WO | WO-2017039614 A1 * | 3/2017 | ..... | F02D 35/024 |

*Primary Examiner* — Hung Q Nguyen
*Assistant Examiner* — Mark L. Greene
(74) *Attorney, Agent, or Firm* — Geoffrey Brumbaugh; McCoy Russell LLP

(57) ABSTRACT

Methods and systems are provided for estimating maximum in-cylinder pressure for all engine cylinders while reducing the number of individual cylinders required for pressure sensing. Pressure sensing is performed for a single instrumented cylinder. For remaining non-instrumented cylinders, an engine speed-dependent correction factor is applied that compensates for compression pressure variation between cylinders due to intake valve closing differences.

20 Claims, 9 Drawing Sheets

EXAMPLE FIRING ORDER
1-3-7-2-6-5-4-8

(56) References Cited

U.S. PATENT DOCUMENTS

| | | | | |
|---|---|---|---|---|
| 2009/0063013 | A1* | 3/2009 | Nakata | F02D 41/3809 701/103 |
| 2017/0051700 | A1 | 2/2017 | Fulton et al. | |

* cited by examiner

700

$P_{max}$ estimation without β correction

| | fuel sweep data | | | phiMI sweep data | | |
|---|---|---|---|---|---|---|
| | rpm <= 2500 | rpm >= 3000 | entire range | rpm <= 2500 | rpm >= 3000 | entire range |
| logical cyl1 | 1.7 | 7.6 | 2.9 | 1.0 | 6.6 | 3.9 |
| logical cyl2 | 1.3 | 6.3 | 2.4 | 1.0 | 6.9 | 4.1 |
| logical cyl3 | 1.6 | 5.2 | 2.3 | 1.1 | 6.1 | 3.6 |
| logical cyl4 | 0.8 | 0.9 | 0.8 | 0.9 | 1.4 | 1.1 |
| logical cyl5 | 2.0 | 7.5 | 3.1 | 1.7 | 8.6 | 5.1 |
| logical cyl6 | 1.4 | 8.3 | 3.0 | 2.0 | 7.8 | 4.8 |
| logical cyl7 | 1.3 | 3.7 | 1.7 | 0.6 | 3.9 | 2.3 |

702

$P_{max}$ estimation with β correction

| | fuel sweep data | | | phiMI sweep data | | |
|---|---|---|---|---|---|---|
| | rpm <= 2500 | rpm >= 3000 | entire range | rpm <= 2500 | rpm >= 3000 | entire range |
| logical cyl1 | 1.2 | 2.4 | 1.4 | 0.8 | 1.8 | 1.2 |
| logical cyl2 | 1.1 | 1.6 | 1.2 | 0.8 | 2.3 | 1.5 |
| logical cyl3 | 1.1 | 1.5 | 1.2 | 0.8 | 1.9 | 1.3 |
| logical cyl4 | 0.8 | 1.2 | 0.9 | 0.9 | 1.2 | 1.0 |
| logical cyl5 | 1.8 | 1.8 | 1.8 | 1.0 | 2.8 | 1.8 |
| logical cyl6 | 1.1 | 3.6 | 1.6 | 1.2 | 2.5 | 1.7 |
| logical cyl7 | 1.1 | 1.1 | 1.1 | 0.7 | 1.6 | 1.1 |

FIG. 7

800

| | Logical Cyl#1 | Logical Cyl#2 | Logical Cyl#3 | Logical Cyl#4 | Logical Cyl#5 | Logical Cyl#6 | Logical Cyl#7 |
|---|---|---|---|---|---|---|---|
| Calibration result | 1.82 | 1.76 | 1.61 | 0.90 | 1.88 | 2.10 | 1.09 |

802

| Data | | Logical Cyl#1 | Logical Cyl#2 | Logical Cyl#3 | Logical Cyl#4 | Logical Cyl#5 | Logical Cyl#6 | Logical Cyl#7 | Data # per cylinder |
|---|---|---|---|---|---|---|---|---|---|
| Dual pilot | Fuel sweep | 1.32 | 1.13 | 1.12 | 1.13 | 1.60 | 1.38 | 1.15 | 957 |
| | phiMI sweep | 1.37 | 1.45 | 1.28 | 0.93 | 1.68 | 1.62 | 1.01 | 297 |
| | EGR sweep | 1.76 | 1.98 | 1.64 | 0.60 | 1.77 | 2.52 | 1.08 | 382 |
| Single pilot | Baseline | 1.55 | 1.20 | 1.29 | 0.81 | 1.72 | 1.66 | 1.12 | 189 |
| | EGR sweep | 1.08 | 0.94 | 0.97 | 0.59 | 1.23 | 1.26 | 0.85 | 373 |

FIG. 8

ENGINE OPERATING SYSTEM AND METHOD

FIELD

The present description relates generally to methods and systems for estimating a maximum in-cylinder pressure in a vehicle engine to cope with cylinder-to-cylinder variation of air charge dynamics and compression pressure.

BACKGROUND/SUMMARY

Increasing lower engine emission standards call for increasingly more sophisticated engine controls. On way to improve engine operation is to install pressure sensors in engine cylinders. The pressure sensors may provide useful feedback information that may be indicative of engine combustion for combustion location, combustion amount, quality, engine performance, durability and engine emissions for each of the cylinders that a pressure sensor is installed in and the engine itself. A pressure sensor may be installed in each engine cylinder so that a controller may evaluate the way the cylinder is operating. For example, if any of the mass fraction burn locations for an individual cylinder is delayed longer than is desired, engine fuel injection timing of that cylinder may be advanced to advance the crankshaft location of the mass fraction burn location during an engine cycle for the particular cylinder.

In some engine systems, engine costs and computational power requirements for processing cylinder pressure sensor data may be reduced by relying on a single pressure sensor. For example, Fulton et al. disclose an engine system in US2017/0051700 wherein a single pressure sensor is coupled a single engine cylinder that provides the lowest root mean square error values. The cylinder pressure (e.g., the maximum in-cylinder pressure) for the single engine cylinder is measured via the single sensor, while the corresponding pressure values for remaining engine cylinders is inferred based on the measured pressure data using a model and measured engine operating conditions.

However the inventors herein have identified potential issues with the above approach. The modeled in-cylinder pressure values for the remaining engine cylinders may be error prone. For example, the modeled values may significantly deviate from measured cylinder pressure values (such as values obtained if each cylinder were installed with a pressure sensor). This may be largely due to cylinder-to-cylinder compression pressure variation due to the air distribution (or dynamic charge air effects) and compression ratio differences between the instrumented and non-instrumented cylinders. In addition, engines typically hold an engineering margin for peak cylinder pressures between a maximum limit and a calibration target. This engineering margin accounts for engine-to-engine and cylinder-to-cylinder variability. Errors in peak cylinder pressure estimation can result in larger margins to account for engine-to-engine and cylinder-to-cylinder variability. This in turn can limit the peak torque that can be supported by the engine.

The inventors have recognized that in model, the in-cylinder pressure trace can be decomposed into compression pressure and combustion pressure components. While the combustion pressure is related to a combustion event governed by fuel injection quantity and timing, the compression pressure is influenced by the air distribution and the compression ratio. While the combustion pressure reconstruction of the non-instrumented cylinders could be obtained by correcting via a crank shaft oscillation model (that accounts for the cylinder-to-cylinder variation of a combustion event due to fuel injection quantity and timing variation), the compression pressure reconstruction was not achievable by similar means. For example, the compression pressure of the non-instrumented cylinders were assumed to be identical to that of the instrumented cylinder neglecting the air distribution and compression ratio cylinder-to-cylinder variation. However, the actual cylinder-to-cylinder variation of the compression pressure changes with engine operating parameters such as engine speed. The compression pressure of each cylinder has an impact upon following pressure traces including combustion pressure, and eventually on the maximum in-cylinder pressure. Consequently, the model encounters error in predicting the maximum in-cylinder pressure due to cylinder-to-cylinder variation of compression pressure. In one example, if the compression pressure is not accurately known and a lower value is assumed for safety reasons, the amount of boost pressure that can be provided to the engine may be unnecessarily limited, limiting engine torque output. On the other hand, if a pressure sensor was installed in each cylinder to reduce the error, the cost and complexity benefit of reduced component usage would be lost. Thus, it may be difficult to balance cost of pressure determination and accuracy of pressure determination.

In one example, the above issues may be at least partly addressed by a method for an engine comprising: measuring a maximum in-cylinder pressure in a first cylinder via a pressure sensor; and inferring the maximum in-cylinder pressure in a second cylinder based on a difference from the measured maximum cylinder pressure of the first cylinder, the difference determined as a function of each of intake valve closing timing of the second cylinder, and cylinder identity. In this way, cylinder-to-cylinder pressure estimation variations can be reduced without needing pressure sensors to installed in each cylinder.

As an example, a multi-cylinder engine system may have a single pressure installed inside one of the engine cylinders (hereafter referred to as the instrumented or indicated cylinder), while remaining engine cylinders do not include any installed sensors (hereafter referred to as the non-instrumented or non-indicated cylinders). During conditions when cylinder pressure estimation is required, such as for estimating fuel injection, boost limits, etc., an engine controller may use the output from the sensor to estimate the maximum in-cylinder pressure for the instrumented cylinder and to infer the maximum in-cylinder pressure for the non-instrumented cylinders. Specifically, for a given non-instrumented cylinder, the controller may modify the measured in-cylinder pressure of the instrumented cylinder with one or more correction factors. As an example, the controller may apply a factor (e.g., alpha) that compensates for the difference in fuel injection quantity and another factor (e.g., delta) that compensates for the difference in fuel injection timing between the cylinders. Further, the controller may modify the measured in-cylinder pressure of the instrumented cylinder with yet another factor (e.g., beta) that compensates for the difference in air charge between cylinders based on the difference in compression pressure between the cylinders at intake valve closing (IVC). For a given cylinder, beta may be mapped as a function of engine speed and torque setpoint. In addition, beta may be mapped as a function of the location and identity of a given non-instrumented cylinder. This is because even for two non-instrumented cylinders having the same IVC, there may be differences in compression pressure due to differences in RAM air effect. In one example, the factor beta may be mapped during dyno testing or calibration of other engine parameters. Based on the mapped maximum in-cylinder pressure of the non-indicated cylinders and the indicated cylinder, engine operating conditions may be adjusted. For example, a maximum permissible boost pressure may be adjusted to be at or within the maximum in-cylinder pressure. As another example, EGR flow to the engine may be adjusted based on the maximum in-cylinder pressure.

In this way, the accuracy of maximum in-cylinder pressure estimation can be improved without requiring additional pressure sensors to be installed in each cylinder. The technical effect of using a correction factor that compensates for differences in compression pressure between cylinders is that cylinder-to-cylinder air charge estimation variation can be reduced. By more accurately estimating the maximum in-cylinder pressure of each cylinder, the boost pressure that can be provided to the engine can be more accurately determined. For example, a higher boost pressure can be provided to the engine. Likewise, a higher EGR flow may be provided. By accurately estimating an increased maximum in-cylinder pressure, an increased maximum torque output of the engine can be better supported.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 7 shows an example table comparing maximum in-cylinder pressure estimation for all non-instrumented engine cylinders with and without application of correction factor beta.

FIG. 8 shows example maximum in-cylinder pressure calibration and validation results.

DETAILED DESCRIPTION

Figure 1:
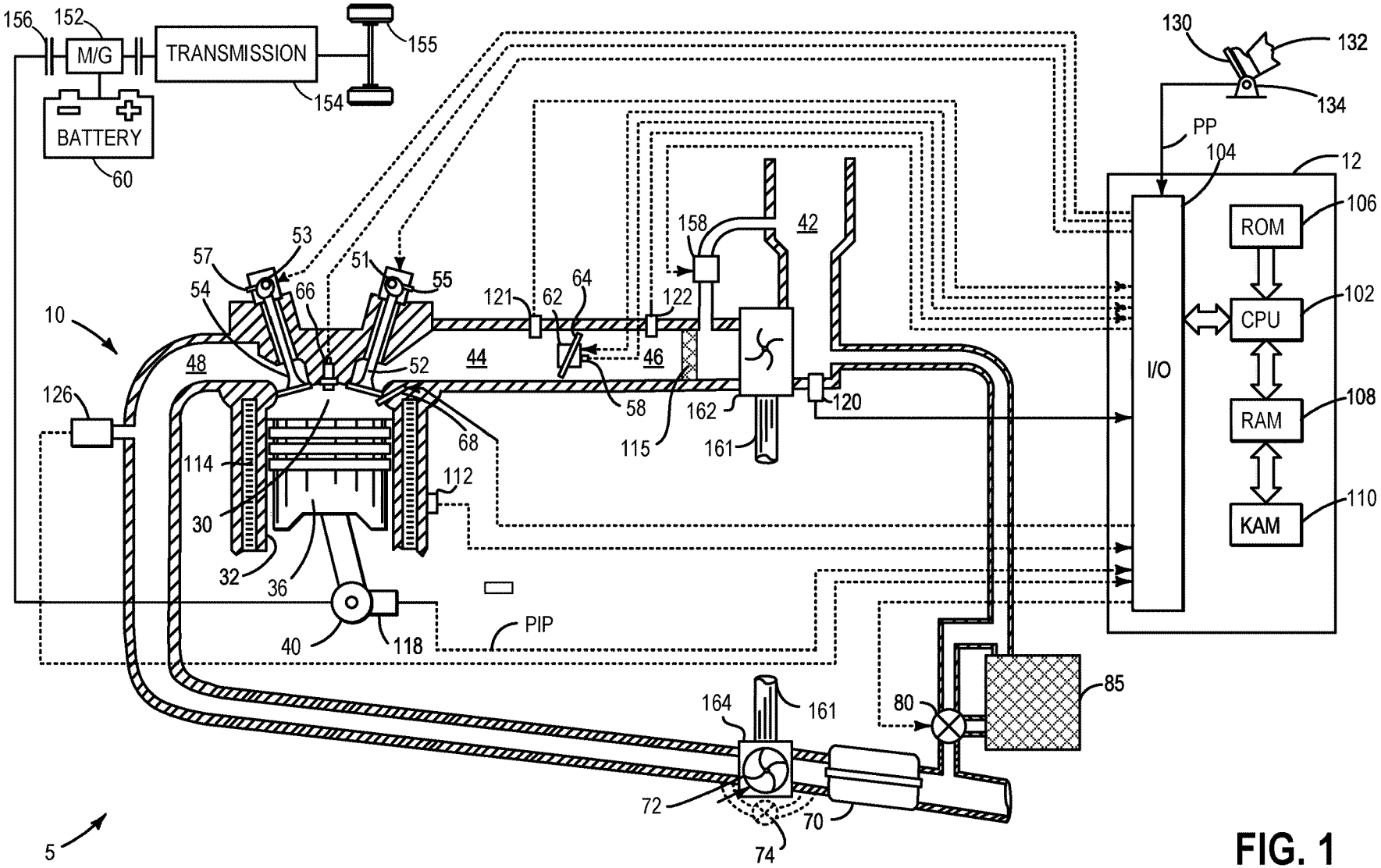
FIG. 1 shows a schematic depiction of an engine system.
Figure 2:
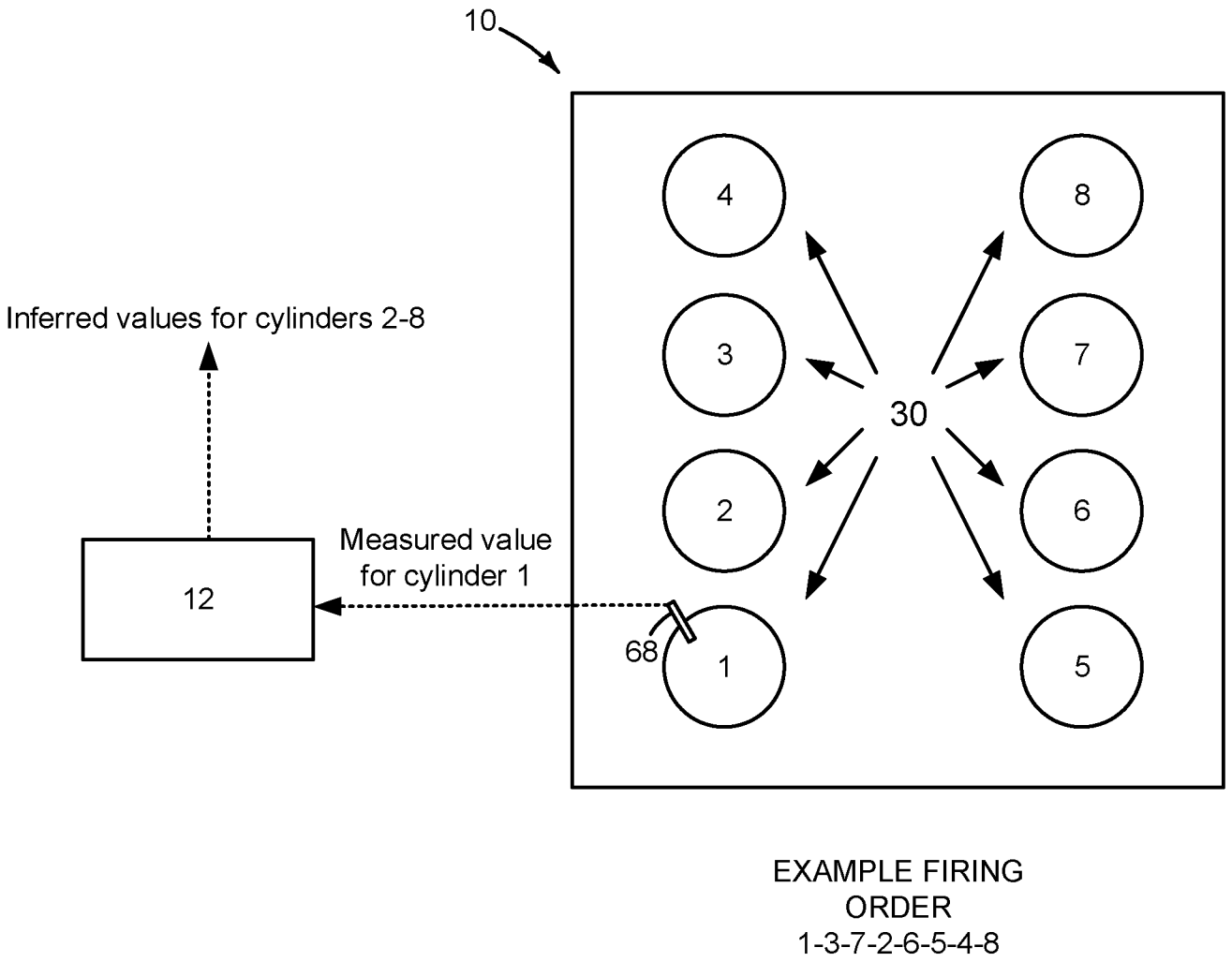
FIG. 2 shows an example an engine with a single instrumented cylinder and remaining non-instrumented cylinders.
Figure 9:
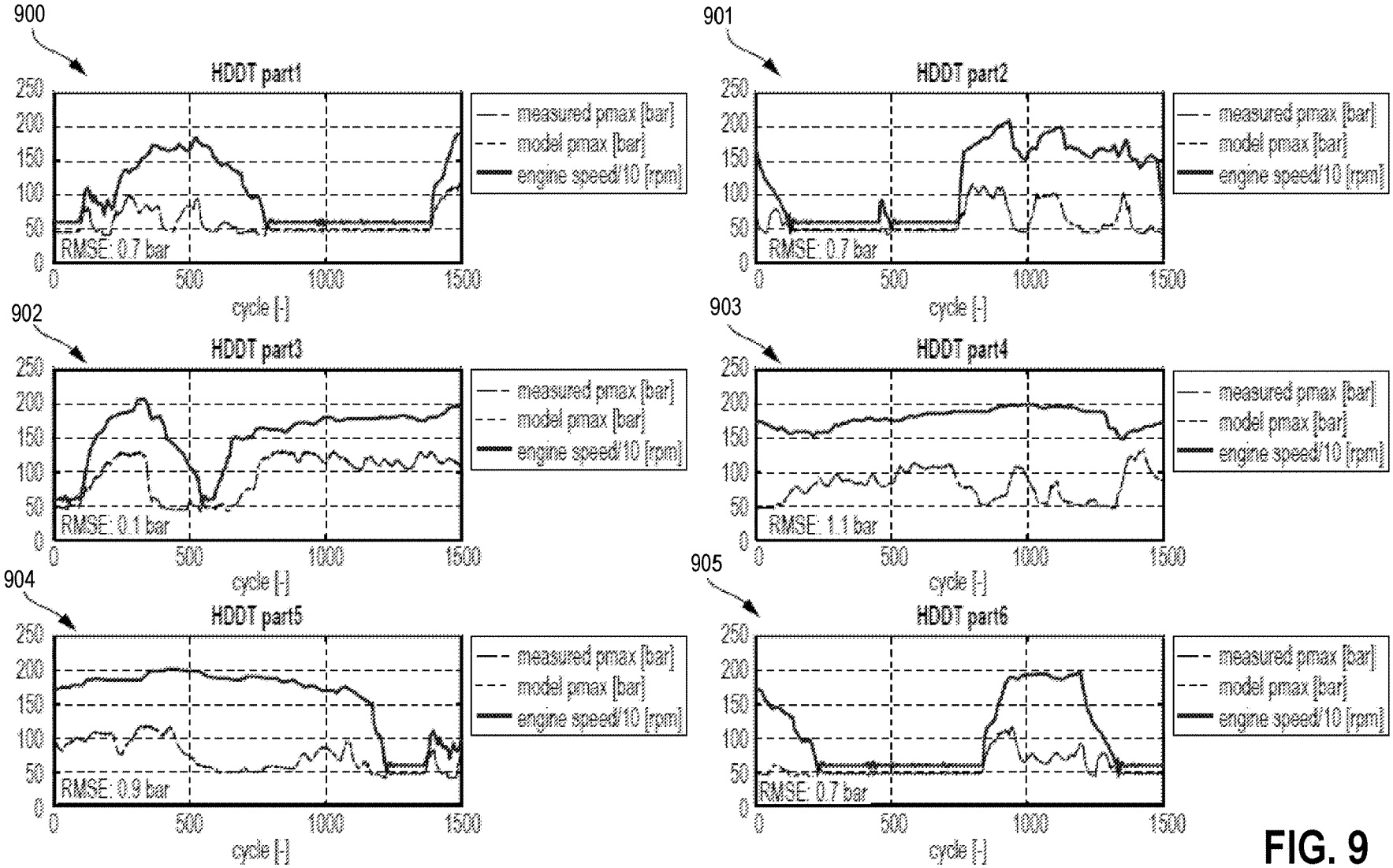
FIG. 9 shows example validation results of a $p_{max}$ estimation model using transient dyno data.

The present description is related to improving combustion within cylinders of an internal combustion engine by accurately estimating maximum in-cylinder pressures. FIG. 1 shows an example cylinder of an internal combustion engine. Only one of the engine cylinders may be instrumented with a pressure sensor, while the remaining cylinders are non-instrumented, such as shown in FIG. 2. An engine controller may be configured to perform a control routine, such as the example routine of FIG. 3, to estimating the maximum in-cylinder pressure for each of the non-instrumented cylinders based on the output of the pressure sensor coupled to the instrumented cylinder and one or more correction factors. The correction factors may include factors that compensate for variation in fuel injection amount, timing, and variations in compression pressure contribution (FIG. 4). The compression pressure variation may be compensated for using a correction factor beta that is calibrated with respect to engine speed and torque (FIG. 5) to improve the accuracy of a maximum in-cylinder pressure estimate (FIG. 6). Example estimation results are shown in the table of FIG. 7. The results are also validated using testing data, as shown in FIGS. 8-9.

Referring to FIG. 1, internal combustion engine 10, comprising a plurality of cylinders, one cylinder of which is shown in FIG. 1, is controlled by electronic engine controller 12. Engine 10 is included in a vehicle 5 configured for on-road propulsion.

Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to a pulse width from controller 12. Fuel is delivered to fuel injector 66 by a fuel system (not shown) including a fuel tank, fuel pump, fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. Charge air cooler 115 cools air compressed by compressor 162. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, waste gate 74 allows exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce intake manifold pressure.

In the depicted example, engine 10 is a compression ignited engine wherein combustion is initiated in combustion chamber 30 when fuel ignites via compression ignition as piston 36 approaches top-dead-center compression stroke. For example, engine 10 may be diesel engine.

In some examples, a universal Exhaust Gas Oxygen (UEGO) sensor 126 may be coupled to exhaust manifold 48 upstream of emissions device 70. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures, glow plug 68 may convert electrical energy into thermal energy so as to raise a temperature in combustion chamber 30. By raising temperature of combustion chamber 30, it may be easier to ignite a cylinder air-fuel mixture via compression. Controller 12 adjusts current flow and voltage supplied to glow plug 68. In this way, controller 12 may adjust an amount of electrical power supplied to glow plug 68. Glow plug 68 protrudes into the cylinder and it may also include a pressure sensor integrated with the glow plug for determining pressure within combustion chamber 30. In alternate examples, such as where the engine is a spark ignited engine, such as a gasoline engine, fuel may be ignited by a spark plug located overhead the cylinder based on a spark advance signal received from the controller 12.

Emissions device 70 can include a particulate filter and catalyst bricks, in one example. In another example, multiple emission control devices, each with multiple bricks, can be used. Emissions device 70 can include an oxidation catalyst in one example. In other examples, the emissions device may include a lean NOx trap or a selective catalyst reduction (SCR), and/or a diesel particulate filter (DPF).

Exhaust gas recirculation (EGR) may be provided to the engine via EGR valve 80. EGR valve 80 is a three-way valve that closes or allows exhaust gas to flow from downstream of emissions device 70 to a location in the engine air intake system upstream of compressor 162. In alternative examples, EGR may flow from upstream of turbine 164 to intake manifold 44. EGR may bypass EGR cooler 85, or alternatively, EGR may be cooled via passing through EGR cooler 85. In other examples, high pressure and low pressure EGR systems may be provided.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by driver 132; a measurement of engine manifold pressure (MAP) from pressure sensor 121 coupled to intake manifold 44; boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In an example aspect of the present description, engine position sensor 118 produces a predetermined number of equally spaced pulses every revolution of the crankshaft from which engine speed (RPM) can be determined.

The controller 12 receives signals from the various sensors of FIG. 1 and employs the various actuators of FIG. 1 to adjust engine operation based on the received signals and instructions stored on a memory of the controller. For example, based on torque demand as inferred based on input from the pedal position sensor, a fuel injection amount and a boost pressure amount may be adjusted.

As elaborated with reference to FIG. 2, one of the engine cylinders may be instrumented with a pressure sensor. The controller may estimate a maximum in-cylinder pressure of a single engine cylinder instrumented with an in-cylinder pressure sensor and adjust combustion parameters for the given cylinder based on the estimated maximum in-cylinder pressure. Further, as elaborated with reference to FIG. 3, the controller may model the maximum in-cylinder pressure for each of the remaining non-instrumented engine cylinders based on the output of the single pressure sensor and further based on a plurality of correction factors. Combustion parameters for the remaining cylinders is then adjusted based on the modeled maximum in-cylinder pressure values. Further, EGR flow and boost pressure settings may be varied based on the maximum in-cylinder pressure values for the cylinders. For example, a higher EGR flow or a higher boost pressure may be enabled in view of a higher maximum in-cylinder pressure value.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

In some examples, vehicle 5 may be a hybrid vehicle with multiple sources of torque available to one or more vehicle wheels 155. In other examples, vehicle 5 is a conventional vehicle with only an engine, or an electric vehicle with only electric machine(s). In the example shown, vehicle 5 includes engine 10 and an electric machine 152. Electric machine 152 may be a motor or a motor/generator. Crankshaft 40 of engine 10 and electric machine 152 are connected via a transmission 154 to vehicle wheels 155 when one or more clutches 156 are engaged. In the depicted example, a first clutch 156 is provided between crankshaft 40 and electric machine 152, and a second clutch 156 is provided between electric machine 152 and transmission 154. Controller 12 may send a signal to an actuator of each clutch 156 to engage or disengage the clutch, so as to connect or disconnect crankshaft 40 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 60 to provide torque to vehicle wheels 155. Electric machine 152 may also be operated as a generator to provide electrical power to charge battery 60, for example during a braking operation.

Referring now to FIG. 2, an example engine 10 (such as engine 10 of FIG. 1) showing locations of cylinder pressure sensors for controlling combustion in engine 10 is shown. In this example, engine 10 includes eight cylinders having combustion chambers 30 that are numbered consecutively from 1-8. A single pressure sensor 68 is shown installed in an engine cylinder. In particular, cylinder number one is instrumented with a pressure sensor 68. Herein, the cylinder having the pressure sensors installed therein is referred to as the indicated cylinder or instrumented cylinder. None of the remaining engine cylinders (numbers two through eight) have a pressure sensor installed therein. These remaining cylinders are herein referred to as the non-indicated or non-instrumented cylinders.

Cylinder pressure feedback provided by pressure sensor 68 located in cylinder number one is the basis for controlling fuel injection timing and quantity, as well as for adjusting combustion, for cylinders 1-8 across a variety of engine speeds and loads. For example, a maximum in-cylinder pressure of cylinder 1 may be measured based on cylinder pressure feedback provided by pressure sensor 68. This measured value is sent to, and stored in the memory of, controller 12. Then, the maximum in-cylinder pressure of cylinders 2-8 may be inferred or modeled by controller 12 based on the maximum in-cylinder pressure of cylinder 1 and further based on a plurality of correction factors (as elaborated at FIG. 3).

In this way, the components of FIGS. 1-2 enables an engine system comprising a first cylinder instrumented with an in-cylinder pressure sensor; a second non-instrumented cylinder; an engine speed sensor coupled to an engine crankshaft; and a controller with computer readable instructions stored on non-transitory memory for measuring a maximum in-cylinder pressure value of the first cylinder via the pressure sensor; calculating a compression pressure correction factor based on each of a position of the second cylinder on an engine block relative to the first cylinder, engine speed, and intake valve closing of the second cylinder relative to the first cylinder; and inferring the maximum in-cylinder pressure value of the second cylinder based on the measured maximum in-cylinder pressure value of the first cylinder and the calculated compression pressure correction factor. Additionally or optionally, the system may further comprise a compressor for providing a boosted air charge to the engine system, and the controller may include further instructions for limiting a boost pressure output by the compressor based on the inferred maximum in-cylinder pressure value, a maximum permissible boost pressure raised as the inferred maximum in-cylinder pressure value increases. In some examples, the system may further comprise an EGR passage for recirculating exhaust gas from an exhaust to an intake of the engine system, the EGR passage including a valve, and the controller may include further instructions for limiting EGR flow based on the inferred maximum in-cylinder pressure value, a maximum permissible EGR flow raised as the inferred maximum in-cylinder pressure value increases. Additionally, the controller may calculate the compression pressure correction factor by estimating ram air received in the second cylinder relative to the first cylinder based on the position of the second cylinder on the engine black relative to the first cylinder, and adjusting the correction factor based on an estimated ram air difference between the second cylinder and the first cylinder. In one example, adjusting the correction factor includes increasing the correction factor as the estimated ram air difference increases. In another example, adjusting the correction factor includes decreasing the correction factor as the estimated ram air difference increases.

In this way, combustion in all engine cylinders is controlled based on cylinder pressure data observed by a single pressure sensor during a cylinder cycle. By reducing the need for pressure sensors to be installed in each cylinder, component cost and complexity is reduced. At the same time, by relying on calibrated correction factors to infer the pressure value for a non-instrumented cylinder using data captured at the single instrumented cylinder, the accuracy of pressure estimation is not compromised. As a result, cylinder combustion may be better controlled.

Figure 3:
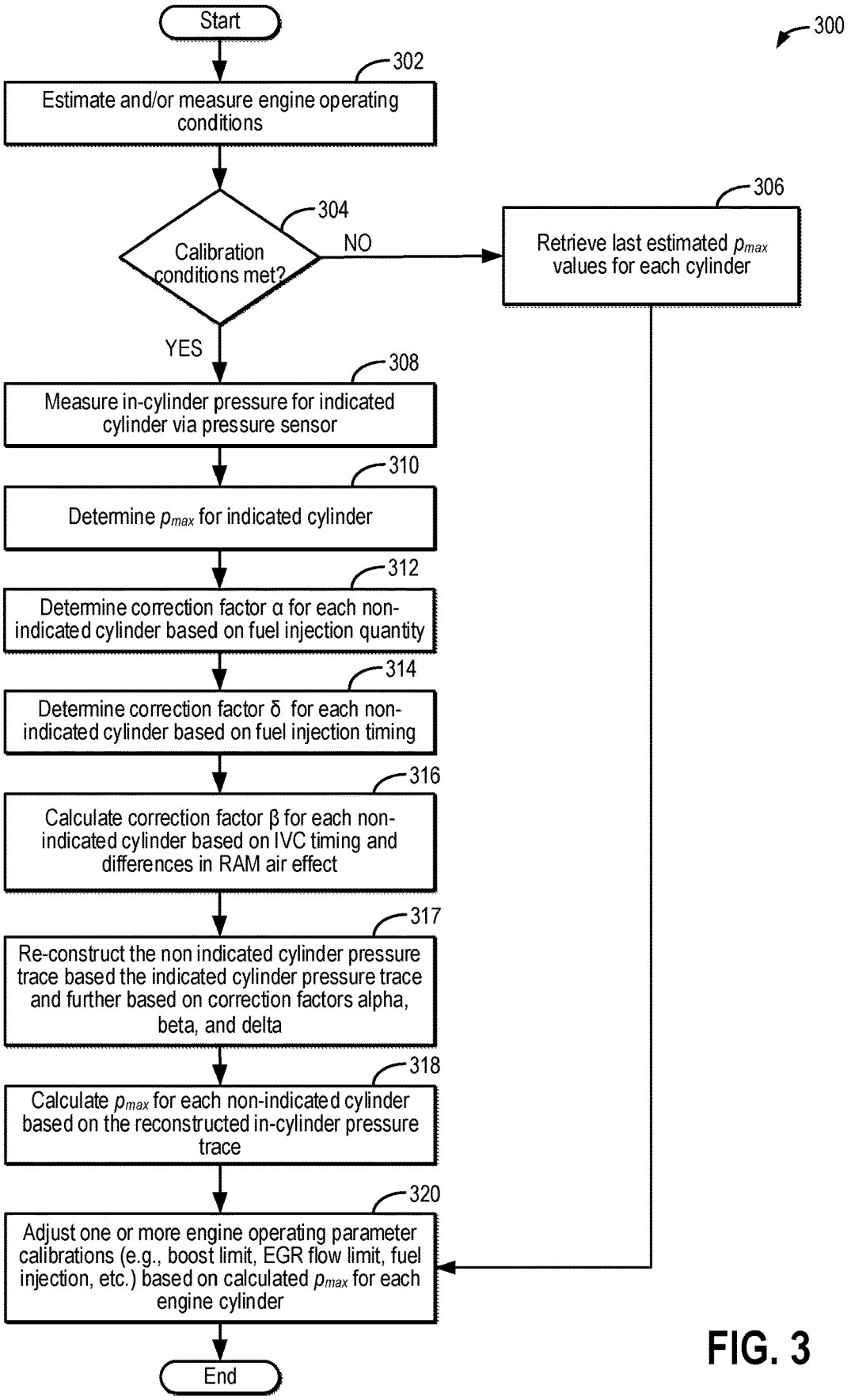
FIG. 3 shows a high level flow chart of an example method for estimating the maximum in-cylinder pressure of the non-instrumented cylinders based on the measured maximum in-cylinder pressure of the instrumented cylinder and one or more correction factors.
Figure 4:
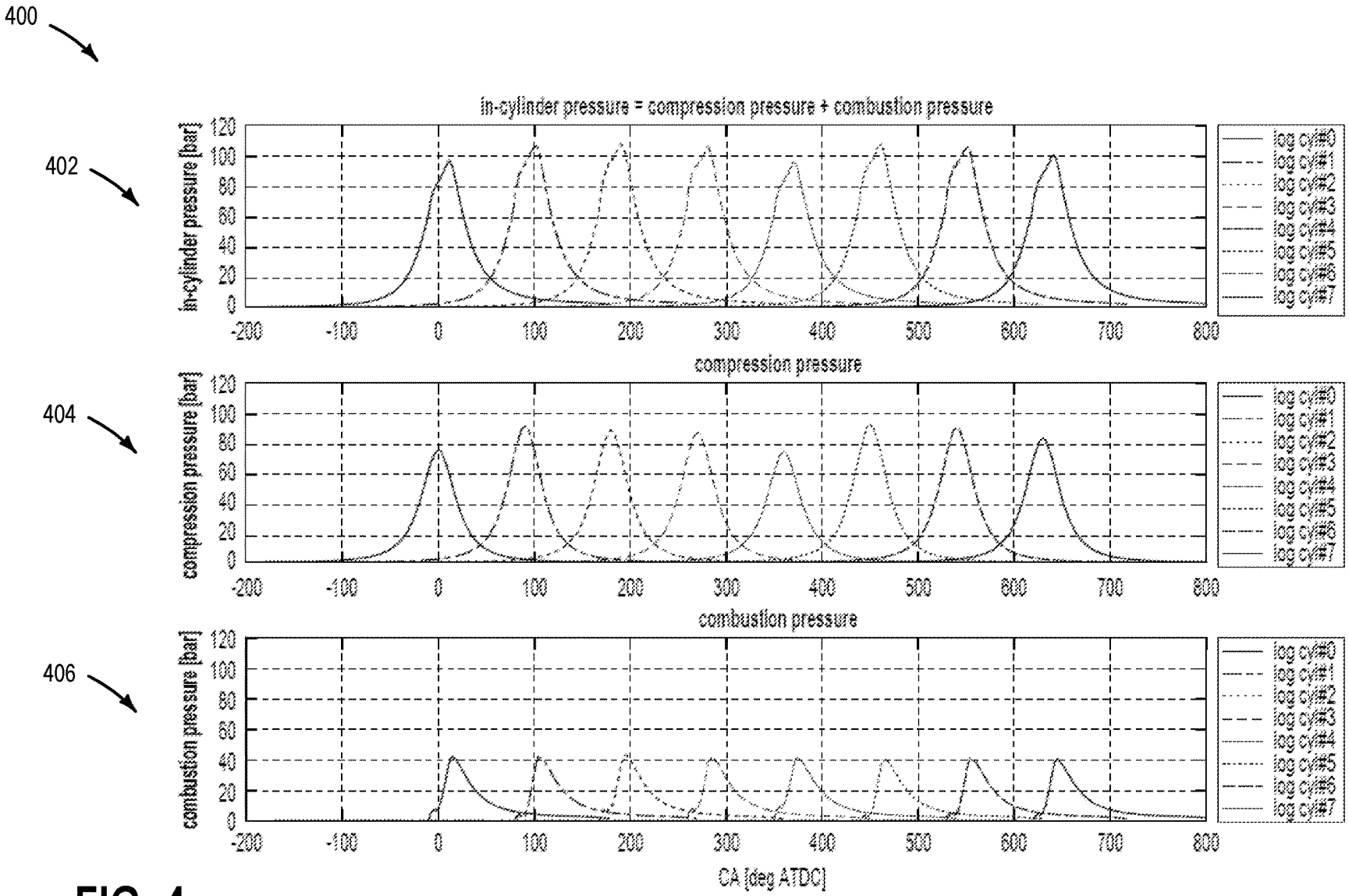
FIG. 4 shows an example contribution of compression pressure variation towards cylinder-to-cylinder maximum in-cylinder pressure variation.

Turning now to FIG. 3, an example method 300 is shown for determining the maximum in-cylinder pressure values ($p_{max}$) for each cylinder of an engine and adjusting engine combustion in accordance. The method enables the $p_{max}$ for all engine cylinders to be accurately determined while relying on a single installed cylinder pressure sensor. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, engine operating conditions may be estimated and/or measured. For example, engine speed, engine temperature, boost pressure, exhaust temperature, exhaust air-fuel ratio, ambient conditions (such as ambient pressure, temperature, and humidity), MAP, MAF, etc. may be measured. At 304, it may be determined if maximum in-cylinder pressure calibration conditions have been met. For example, it may be determined if a threshold duration or distance of vehicle (or engine) operation has elapsed since a last estimation of the maximum in-cylinder pressure for all engine cylinders. As another example, calibration conditions may be considered met if one or more engine operating parameters such as engine coolant temperature, fuel injection quantity, and engine speed fulfill enablement conditions for pressure measurement and/or maximum in-cylinder pressure ($p_{max}$) model execution.

If calibration conditions are not met, then at 306, the method includes retrieving a last estimated value of maximum in-cylinder pressure, or $p_{max}$, for each of the engine cylinders. Then, at 320, one or more engine operating parameters and their calibration may be adjusted based on the retrieved values. For example, one or more of a boost pressure limit, an EGR limit, fuel injection (amount and timing), etc., may be calculated based on the $p_{max}$ value of each cylinder.

Returning to 304, if calibration conditions are met, then at 308, the method includes measuring the in-cylinder pressure for the indicated or instrumented cylinder via the in-cylinder pressure sensor (ICPS) installed therein. For example, sensor output may be collected. At 310, the method includes determining $p_{max}$ for the indicated cylinder. For example, the controller may choose the maximum value in the measured in-cylinder pressure trace.

At 312, the method includes determining a correction factor alpha ($\alpha$) for each of the remaining non-indicated or non-instrumented cylinders. Correction factor $\alpha$ may be a correction that compensates for fuel injection quantity. At 314, the method includes determining a correction factor delta ($\delta$) for each of the non-indicated or non-instrumented cylinders. Correction factor $\delta$ may be a correction that compensates for fuel injection timing.

At 316, the method includes calculating a correction factor beta ($\beta$) for each of the non-indicated or non-instrumented cylinders. Correction factor $\beta$ may be based on cylinder intake valve closing (IVC) timing and may account for differences in ram air effect. In particular, these differences can result in a compression pressure variation between cylinders which in turn affects $p_{max}$ values for each cylinder.

At 317, the method includes re-constructing the non-indicated cylinder pressure trace based the indicated cylinder pressure trace and further based on the correction factors alpha, beta, and delta. At 318, the method includes calculating $p_{max}$ for each of the non-indicated cylinders based on the re-constructed in-cylinder pressure trace.

Then, at 320, one or more engine operating parameters and their calibrations may be adjusted based on the determined values. For example, one or more of a boost pressure limit, an EGR limit, fuel injection (amount and timing), etc., may be calculated based on the $p_{max}$ value of each cylinder. In one example, as the average maximum in-cylinder pressure value across the engine cylinders becomes larger, the boost limit may be raised and a higher boost pressure may be enabled. Likewise, the EGR limit may be raised and a higher EGR flow may be enabled. As another example, a fuel injection amount may be increased without incurring a rich air-fuel ratio excursion.

When modeling cylinder pressure trace with a single ICPS for predicting in-cylinder pressure traces for the other cylinders, errors in the in-cylinder pressure traces prediction versus measured may be encountered. The root cause of errors was determined to be the cylinder-to-cylinder compression pressure variation due to the air distribution and compression ratio differences between the instrumented and non-instrumented cylinders.

In the model, an in-cylinder pressure trace was decomposed into compression pressure and combustion pressure traces, as shown with reference to FIG. 4. While the combustion pressure is related to a combustion event governed by fuel injection quantity and timing, the compression pressure is influenced by the air distribution and the compression ratio.

Turning briefly to FIG. 4, map 400 depicts a trace of total in-cylinder pressure for all engine cylinders instrumented with corresponding pressure sensors at plot 402. The total in-cylinder pressure is then decomposed into constituent combustion pressure (cmb) traces at plot 406 and compression pressure (cmp) traces at plot 404. For a given cylinder, the in-cylinder pressure trace that is measured ($p_{cyl}(\theta)$) can be determined as:

$$p_{cyl}(\theta)=p_{cmp}(\theta)+p_{cmb}(\theta),$$

wherein $\theta$ is crank angle.

As can be seen at FIG. 4, the maximum in-cylinder pressure cylinder-to-cylinder variation is maintained caused by the compression pressure variation rather than the combustion pressure variation. The combustion pressure is governed by the combustion related to fuel injection quantity and timing. At a given engine operating point, the cylinder-to-cylinder fuel injection variation is smaller than the air charge variation that influences the compression pressure variation.

For the combustion pressure reconstruction of the non-indicated cylinder, it was assumed that the shape of the combustion pressure would be identical to that of the indicated cylinder, and the combustion pressure could be corrected by a crank shaft oscillation model in order to consider the cylinder-to-cylinder variation of combustion events due to fuel injection quantity and timing variation. The compression pressure of the non-indicated cylinders was initially assumed to be identical to that of indicated cylinder neglecting the air distribution and compression ratio cylinder-to-cylinder variation.

Figure 5:
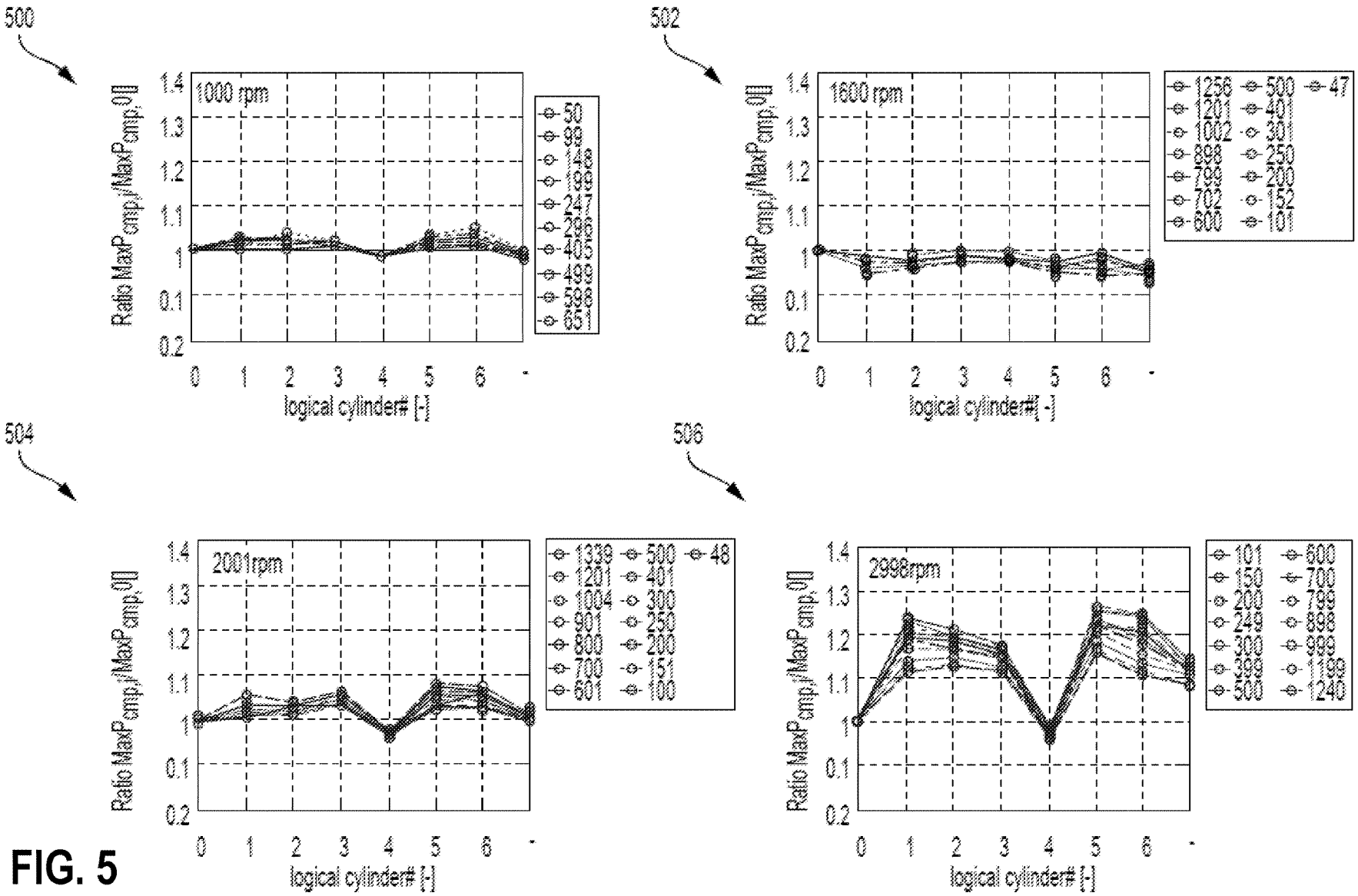
FIG. 5 shows example variations in correction factor beta calibration with engine speed and torque set-point.
Figure 6:
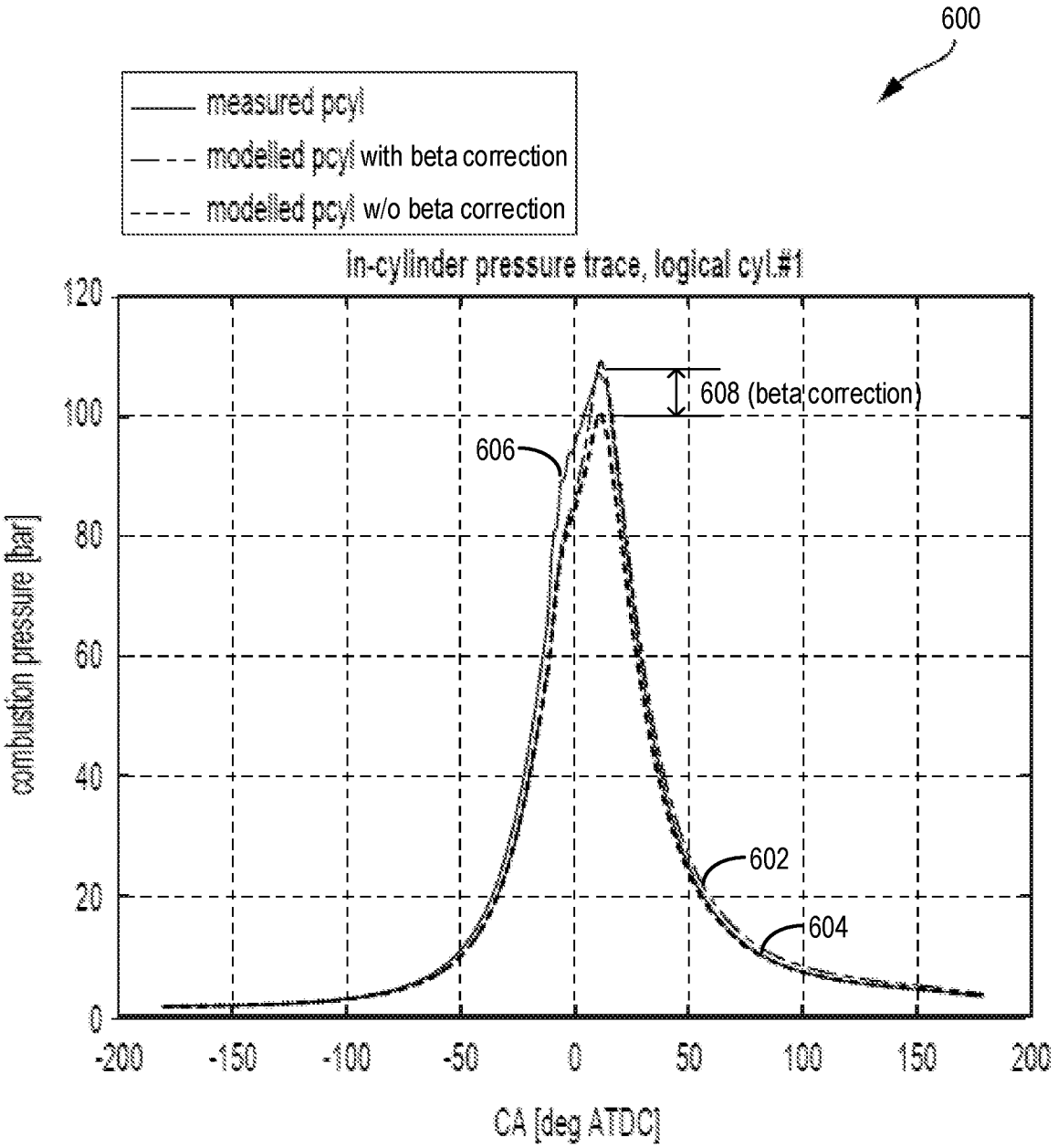
FIG. 6 shows an example comparison of in-cylinder pressure trace estimation with and without application of correction factor beta.

However, the actual cylinder-to-cylinder variation of the compression pressure increases as engine speed increase, as indicated at FIG. 5. The compression pressure of each cylinder has an impact upon following pressure traces (combustion pressure), and eventually it affects the maximum in-cylinder pressure. Consequently, the model encounters error in predicting the maximum in-cylinder pressure if the model does not consider the cylinder-to-cylinder variation of compression pressure.

In one example, the error may have a magnitude of up to 2 bar of RMSE (root-mean-square-error) full ranges at low speed range and up to 9 bar of RMSE full ranges at higher speed in case of neglecting the compression pressure variation. Errors of this magnitude could preclude the use of cylinder pressure trace estimation for predicting maximum cylinder pressure. As discussed above, the main sources of variation in the in-cylinder pressure between cylinders are due to timing (delta), fuel quantity (alpha) and pressure at intake valve closing (beta) as indicated by the equation:

$$\hat{p}_{cyl,i}(\text{modelled } p_{cyl})=p_{cmp,0}+\hat{p}_{cmb,i}=p_{cmp,0}+\beta_i\cdot[\alpha_i\cdot p_{cmb,0}\,(\theta-\delta_i)]$$

wherein $p_{cmp,0}$ and $p_{cmb,0}$ refer to the compression pressure and combustion pressure, respectively, and are known based on the ICPS measurement in the indicated cylinder.

Correction factor delta for a given cylinder ($\delta_i$) is determined as $$\delta_i=CA50_i-CA50_0$$

wherein $CA50_0$ is the ICPS measurement in the indicated cylinder and $CA50_i$ is the output of the crankshaft oscillation model.

Correction factor alpha for a given cylinder ($\alpha_i$) is determined through the following equation:

$$trq_{Inr,i}=\int p_{cyl,i}dV=\int p_{cmp,0}dV+\alpha_i\int p_{cmb,0}(\theta-\delta_i)dV$$

wherein $trq_{Inr,i}$ is a known value that is output from the crank shaft oscillation model, $p_{cmp,0}$ and $p_{cmb,0}$ are known values from the indicated cylinder ICPS measurement, delta is determined by $CA50_i - CA50_0$ and dV is a given value. Hence alpha can be calculated.

Correction factor beta for a given cylinder ($\beta_i$) is then determined as:

$$\beta_i = \frac{\max(p_{cmp,i})}{\max(p_{cmp,o})}$$

Then, the maximum in-cylinder pressure for a given cylinder is determined as:

$$\hat{p}_{max,i} = \max(\hat{p}_{cyl,i})$$

Specifically, the pressure trace of each non-indicated cylinder can be re-constructed based on the indicated cylinder pressure trace, and further based on correction factors alpha, beta, and delta. The maximum in-cylinder pressure of the non-indicated cylinder can then be predicted based on the re-constructed pressure trace.

The factors alpha and delta can be can be calculated using the single ICPS measurement and the crank shaft oscillation model. In addition, the factor beta may be applied to account for differences in air charge between cylinders. Beta is a function of primarily engine speed, and engine load, and is calibrated for an engine family. The addition of the factor beta improves the estimated for maximum in-cylinder pressure from ~5 bar to ~1.5 bar.

An example beta calibration is shown with reference to plots 500-506 of FIG. 5. In particular, FIG. 5 shows beta patterns with respect to four different engine speed and various torque set-points per cylinder at plots 500-506. As shown in FIG. 5, beta changes with engine speed and torque set-point and beta value increases with increase of engine speed. Hence beta can be approximated to be a function of engine speed and torque set-point. In each case, the correction factor beta that compensates for the encountered error by compression ratio and air distribution effect, beta, may be defined as the ratio of maximum compression pressure of an indicated cylinder to that of the non-indicated cylinder.

In still further examples, beta can be estimated from engine operating conditions such as intake manifold pressure in real time. An engine controller may map the factor beta per cylinder as a function of engine speed (or engine speed & torque set-point). This correction is then called $\beta_i$ wherein the subscript i refers to the cylinder number.

After analyzing data, it was found that the cylinder-to-cylinder variation of the compression pressure increases as the engine speed increases, and the maximum in-cylinder pressure variation is mainly influenced by the compression pressure variation even with fixed commanded fuel injection quantity and timing at a given engine operating condition. Each cylinder combustion pressure trace has similar magnitude and phasing with each other's at a given engine operating condition because the fuel injection quantity and timing variation are relatively small at normal condition comparing to the compression pressure variation.

The air distribution variation which is the root cause of the compression pressure cylinder-to-cylinder variation is mainly caused by ram air effect (air path dynamics), and the ram air effect is strongly related to engine geometry. For example, the amount of ram air ingested in a given cylinder may be a function of a location of the cylinder along an engine block, and further in reference to intake runners, intake passage, or intake plenum location. Once an engine geometric design is fixed, the ram air effect has a pattern depending on engine speed (or engine speed and torque set-point) which means the correction factor beta can be configured as a map as a function of engine speed (or engine speed and torque set-point). When a single pressure sensor is installed in an indicated cylinder, a corresponding beta value for the non-indicated cylinders (the ratio maximum compression pressure of the indicated cylinder to that of the non-indicated cylinder) may also be pre-defined through calibration using typical dyno mapping data. In addition, this correction factor can be easily applied to different engines after a simple calibration process.

In this way, a controller may measure a maximum in-cylinder pressure in a first cylinder via a pressure sensor; and then infer the maximum in-cylinder pressure in a second cylinder based on a difference from the measured maximum cylinder pressure of the first cylinder. The difference is determined as a function of each of intake valve closing timing of the second cylinder, and cylinder identity. In one example, the difference determined as a function of cylinder identity includes the difference determined as a function of one or more of a location of the cylinder on an engine block, a position of the cylinder in relation to an intake plenum or intake runner, and engine firing order. For example, it may be determined if a cylinder is closer to or further from an intake plenum so that the ram air effect on the first cylinder relative to the ram air effect on the second cylinder can be better estimated and accounted for. Thus, the difference determined as a function of cylinder identity is used to infer a difference due to ram air effect on the second cylinder relative to the first cylinder. In this example, the pressure sensor is installed in the first cylinder (also referred to as the instrumented or indicated cylinder) and not the second cylinder (also referred to as the non-instrumented or non-indicated cylinder). The difference determined as a function of intake valve closing timing may further include applying a correction factor that varies based on engine speed. This is because the difference determined as a function of intake valve closing (IVC) timing includes a difference in compression pressure between the second cylinder and the first cylinder due to the differences in IVC timing. The inferring may be further based on a difference in combustion pressure between the second cylinder and the first cylinder, the difference in combustion pressure estimated as a function of fuel injection amount and fuel injection timing.

In some examples, the controller may further adjust an operating parameter of the second cylinder to maintain actual cylinder pressure at or below the maximum in-cylinder pressure of the second cylinder. For example, the controller may retard spark timing to a limit based on the maximum in-cylinder pressure. As another example, the controller may limit boost pressure based on the maximum in-cylinder pressure, thereby allowing for a higher absolute boost pressure and higher engine output. As yet another example, the controller may limit exhaust gas recirculation flow based on the maximum in-cylinder pressure, thereby allowing for a higher absolute amount of EGR flow that can be provided.

FIG. 6 shows an example comparison of an in-cylinder pressure trace with and without beta correction. As shown at map 600, a comparison of plot 604 (modeled value without beta correction) and plot 602 (modeled value with beta correction) shows a significant variation 608, herein corresponding to beta. In addition, the beta corrected modeled pressure trace of plot 602 better coincides with the actual measured pressure trace plot 606 for a corresponding cylinder with an instrumented pressure sensor. In other words, the reconstructed pressure trace with the beta correction predicts $p_{max}$ with higher accuracy and reliability.

The model with the correction factor beta was also validated using various steady and transient dyno data sets. As shown at FIGS. 7-9, the modeled approach was able to predict the maximum in-cylinder pressure with less than 2.5 bar of RMSE at full engine operation ranges.

FIG. 7. shows an example $p_{max}$ estimation comparison between data collected with (table 702) and without (table 700) beta correction using fuel sweep and main injection timing (phiMI) sweep data. As shown, beta correction improves $p_{max}$ estimation, especially at higher engine speed conditions. $p_{max}$ estimation accuracy is improved from 3.1 bar of RMSE to 1.8 bar of RMSE with fuel sweep data, and the accuracy is improved from 5.1 bar to 1.8 bar of RMSE with phiMI sweep data.

For the fuel and phiMI sweep test, fuel quantity or main injection timing of one cylinder is biased to 4 different values compared to the baseline condition at a given engine operating point, and the fuel quantity and injection timing of the remaining cylinders are kept same as with the baseline condition. In the data set shown at FIG. 7, eight cylinder fuel and phiMI sweep tests were performed at 42 distinct engine operating points.

FIG. 8 depicts validation results using steady state data sets at tables 800, 802. The model was validated using various data sets, and the $p_{max}$ estimation accuracy is less than 2.5 bar of RMSE at full engine operation ranges. For the EGR sweep test, EGR level was changed to 3 or 5 biased level comparing to the baseline condition at each engine operating point. In the data set shown at FIG. 8, 120 engine operating points were used for the EGR sweep.

FIG. 9 depicts validation results using transient dyno test data at plots 900-905. Therein the model was also validated using the transient dyno test data which is an HDDT (Heavy Duty Diesel Truck) cycle. The model predicts the $p_{max}$ with less than 1.1 bar of RMSE.

In one example, the controller may measure the in-cylinder pressure of the indicated cylinder and then determine the maximum in-cylinder pressure of the non-indicated cylinders based on a calculation using a look-up table with the input being the in-cylinder pressure of the indicated cylinder and the current engine speed and load. The output generated includes the different correction factors. The factors are then used in a calculation, model, equation or algorithm to determine the maximum in-cylinder pressure of each of the non-indicated cylinders. For example, the controller may measure cylinder pressure for a cylinder instrumented with a pressure sensor; and then for each remaining non-instrumented cylinder, the controller may model the cylinder pressure based on the measured cylinder pressure and a difference from the measured cylinder pressure, the difference determined based on each of variation in compression pressure and ram air between cylinders. Thereafter, the controller may adjust engine boost pressure based on the modeled cylinder pressure. The controller may also estimate the variation in compression pressure by applying an engine speed dependent correction factor to the measured cylinder pressure. Further, the controller may estimate the variation in ram air between the engine cylinders based on intake valve closing timing of each of the remaining non-instrumented cylinders relative to the instrumented cylinder. The variation in ram air may be further estimated based on cylinder position along an engine block and firing order. This accounts for the variation in compression pressure. The modeled cylinder pressure may be further based on variation in combustion pressure, the variation in combustion pressure estimated based on fuel injection amount and fuel injection timing of each of the remaining non-instrumented cylinder relative to the instrumented cylinder. In this way, air charge estimation is improved while reducing the number of pressure sensors required, and without compromising accuracy. By sensing the maximum in-cylinder pressure in one cylinder and inferring the value in remaining cylinders by applying various correction factors, the contribution of differences in combustion pressure and compression pressure between cylinders can be better accounted for. By accounting for differences in IVC timing between cylinders, the differences in compression pressure between cylinders may be accurately estimated. By also accounting for differences in cylinder position, the different ram air effect experienced in each cylinder can be better estimated. By accurately estimating the maximum in-cylinder pressure of each cylinder, engine pressure limits may be updated, allowing for boost and EGR to be more optimally scheduled. Consequently, engine performance can be improved while supporting a higher engine output.

An example method comprises: measuring a maximum in-cylinder pressure in a first cylinder via a pressure sensor; and inferring the maximum in-cylinder pressure in a second cylinder based on a difference from the measured maximum cylinder pressure of the first cylinder, the difference determined as a function of each of intake valve closing timing of the second cylinder, and cylinder identity. In the preceding example, additionally or optionally, the difference determined as a function of cylinder identity includes the difference determined as a function of one or more of a location of the cylinder on an engine block, a position of the cylinder in relation to an intake plenum or intake runner, and engine firing order. In any or all of the preceding examples, additionally or optionally, the difference determined as a function of cylinder identity includes a difference due to ram air effect on the second cylinder relative to the first cylinder. In any or all of the preceding examples, additionally or optionally, the pressure sensor is installed in the first cylinder and not the second cylinder. In any or all of the preceding examples, additionally or optionally, the difference determined as a function of intake valve closing timing includes applying a correction factor that varies based on engine speed. In any or all of the preceding examples, additionally or optionally, the difference determined as a function of intake valve closing timing includes a difference in compression pressure between the second cylinder and the first cylinder. In any or all of the preceding examples, additionally or optionally, the inferring is further based on a difference in combustion pressure between the second cylinder and the first cylinder, the difference in combustion pressure estimated as a function of fuel injection amount and fuel injection timing. In any or all of the preceding examples, additionally or optionally, the method further comprises adjusting an operating parameter of the second cylinder to maintain actual cylinder pressure at or below the maximum in-cylinder pressure of the second cylinder. In any or all of the preceding examples, additionally or optionally, the adjusting includes one or more of retarding spark timing to a limit based on the maximum in-cylinder pressure, limiting boost pressure based on the maximum in-cylinder pressure, and limiting exhaust gas recirculation flow based on the maximum in-cylinder pressure.

Another example engine method comprises measuring cylinder pressure for a cylinder instrumented with a pressure sensor; for each remaining non-instrumented cylinder, modeling the cylinder pressure based on the measured cylinder pressure and a difference from the measured cylinder pressure, the difference determined based on each of variation in compression pressure and ram air between cylinders; and adjusting engine boost pressure based on the modeled cylinder pressure. In the preceding example, additionally or optionally, the method further comprises estimating the variation in compression pressure by applying an engine speed dependent correction factor to the measured cylinder pressure. In any or all of the preceding examples, additionally or optionally, the method further comprises estimating the variation in ram air based on intake valve closing timing of each of the remaining non-instrumented cylinder relative to the instrumented cylinder. In any or all of the preceding examples, additionally or optionally, the estimating the variation in ram air is further based on cylinder position along an engine block and firing order. In any or all of the preceding examples, additionally or optionally, the modeled cylinder pressure is further based on variation in combustion pressure, the variation in combustion pressure estimated based on fuel injection amount and fuel injection timing of each of the remaining non-instrumented cylinder relative to the instrumented cylinder.

Another example engine system comprises a first cylinder instrumented with an in-cylinder pressure sensor; a second non-instrumented cylinder; an engine speed sensor coupled to an engine crankshaft; and a controller with computer readable instructions stored on non-transitory memory for measuring a maximum in-cylinder pressure value of the first cylinder via the pressure sensor; calculating a compression pressure correction factor based on each of a position of the second cylinder on an engine block relative to the first cylinder, engine speed, and intake valve closing of the second cylinder relative to the first cylinder; and inferring the maximum in-cylinder pressure value of the second cylinder based on the measured maximum in-cylinder pressure value of the first cylinder and the calculated compression pressure correction factor. In the preceding example, additionally or optionally, the system further comprises a compressor for providing a boosted air charge to the engine system, and the controller includes further instructions for limiting a boost pressure output by the compressor based on the inferred maximum in-cylinder pressure value, a maximum permissible boost pressure raised as the inferred maximum in-cylinder pressure value increases. In any or all of the preceding examples, additionally or optionally, the system further comprises an EGR passage for recirculating exhaust gas from an exhaust to an intake of the engine system, the EGR passage including a valve, and the controller includes further instructions for limiting EGR flow based on the inferred maximum in-cylinder pressure value, a maximum permissible EGR flow raised as the inferred maximum in-cylinder pressure value increases. In any or all of the preceding examples, additionally or optionally, calculating the compression pressure correction factor includes estimating ram air received in the second cylinder relative to the first cylinder based on the position of the second cylinder on the engine black relative to the first cylinder, and adjusting the correction factor based on an estimated ram air difference between the second cylinder and the first cylinder. In any or all of the preceding examples, additionally or optionally, adjusting the correction factor includes increasing the correction factor as the estimated ram air difference increases. In any or all of the preceding examples, additionally or optionally, adjusting the correction factor includes decreasing the correction factor as the estimated ram air difference increases.

In a further representation, the engine system is coupled in a hybrid vehicle system. In another further representation, the engine system is coupled in an autonomous vehicle system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

measuring a maximum in-cylinder pressure in a first cylinder via a pressure sensor; and inferring the maximum in-cylinder pressure in a second cylinder based on a difference from the measured maximum cylinder pressure of the first cylinder, the difference determined as a function of each of intake valve closing timing of the second cylinder, and cylinder identity.

2. The method of claim 1, wherein the difference determined as a function of cylinder identity includes the difference determined as a function of one or more of a location of the cylinder on an engine block, a position of the cylinder in relation to an intake plenum or an intake runner, and engine firing order.

3. The method of claim 1, wherein the difference determined as a function of cylinder identity includes a difference due to ram air effect on the second cylinder relative to the first cylinder.

4. The method of claim 1, wherein the pressure sensor is installed in the first cylinder and not the second cylinder.

5. The method of claim 1, wherein the difference determined as a function of intake valve closing timing includes applying a correction factor that varies based on engine speed.

6. The method of claim 1, wherein the difference determined as a function of intake valve closing timing includes a difference in compression pressure between the second cylinder and the first cylinder.

7. The method of claim 1, wherein the inferring is further based on a difference in combustion pressure between the second cylinder and the first cylinder, the difference in combustion pressure estimated as a function of fuel injection amount and fuel injection timing.

8. The method of claim 1, further comprising, adjusting an operating parameter of the second cylinder to maintain actual cylinder pressure at or below the maximum in-cylinder pressure of the second cylinder.

9. The method of claim 8, wherein the adjusting includes one or more of retarding spark timing to a limit based on the maximum in-cylinder pressure, limiting boost pressure based on the maximum in-cylinder pressure, and limiting exhaust gas recirculation flow based on the maximum in-cylinder pressure.

10. An engine method, comprising:

measuring cylinder pressure for a cylinder instrumented with a pressure sensor;

for each remaining non-instrumented cylinder, modeling the cylinder pressure based on the measured cylinder pressure and a difference from the measured cylinder pressure, the difference determined based on each of variation in compression pressure and variation in ram air between cylinders; and adjusting engine boost pressure based on the modeled cylinder pressure.

11. The method of claim 10, further comprising estimating the variation in compression pressure by applying an engine speed dependent correction factor to the measured cylinder pressure.

12. The method of claim 10, further comprising estimating the variation in ram air based on intake valve closing timing of each of the remaining non-instrumented cylinder relative to the instrumented cylinder.

13. The method of claim 12, wherein the estimating the variation in ram air is further based on cylinder position along an engine block and firing order.

14. The method of claim 12, wherein the modeled cylinder pressure is further based on variation in combustion pressure, the variation in combustion pressure estimated based on fuel injection amount and fuel injection timing of each of the remaining non-instrumented cylinder relative to the instrumented cylinder.

15. An engine system, comprising:

a first cylinder instrumented with an in-cylinder pressure sensor;

a second non-instrumented cylinder;

an engine speed sensor coupled to an engine crankshaft; and a controller with computer readable instructions stored on non-transitory memory for:

measuring a maximum in-cylinder pressure value of the first cylinder via the pressure sensor;

calculating a compression pressure correction factor based on each of a position of the second cylinder on an engine block relative to the first cylinder, engine speed, and intake valve closing of the second cylinder relative to the first cylinder; and inferring the maximum in-cylinder pressure value of the second cylinder based on the measured maximum in-cylinder pressure value of the first cylinder and the calculated compression pressure correction factor.

16. The system of claim 15, further comprising a compressor for providing a boosted air charge to the engine system, wherein the controller includes further instructions for:

limiting a boost pressure output by the compressor based on the inferred maximum in-cylinder pressure value, a maximum permissible boost pressure raised as the inferred maximum in-cylinder pressure value increases.

17. The system of claim 15, further comprising an EGR passage for recirculating exhaust gas from an exhaust to an intake of the engine system, the EGR passage including a valve, wherein the controller includes further instructions for:

limiting EGR flow based on the inferred maximum in-cylinder pressure value, a maximum permissible EGR flow raised as the inferred maximum in-cylinder pressure value increases.

18. The system of claim 15, wherein calculating the compression pressure correction factor includes estimating ram air received in the second cylinder relative to the first cylinder based on the position of the second cylinder on the engine black relative to the first cylinder, and adjusting the compression pressure correction factor based on an estimated ram air difference between the second cylinder and the first cylinder.

19. The system of claim 18, wherein adjusting the compression pressure correction factor includes increasing the compression pressure correction factor as the estimated ram air difference increases.

20. The system of claim 18, wherein adjusting the compression pressure correction factor includes decreasing the compression pressure correction factor as the estimated ram air difference increases.

* * * * *